US008714053B2

(12) United States Patent
Krauter

(10) Patent No.: US 8,714,053 B2
(45) **Date of Patent: *May 6, 2014**

(54) CUTTER INSERT GUM MODIFICATION METHOD AND APPARATUS

(71) Applicant: Herrenknecht Tunneling Systems, Sumner, WA (US)

(72) Inventor: David Krauter, Sumner, WA (US)

(73) Assignee: Herrenknecht Tunneling Systems, Sumner, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/653,315

(22) Filed: Oct. 16, 2012

(65) Prior Publication Data

US 2013/0099553 A1 Apr. 25, 2013

Related U.S. Application Data

(63) Continuation of application No. 12/177,350, filed on Jul. 22, 2008, now abandoned, which is a continuation-in-part of application No. 11/088,397, filed on Mar. 23, 2005, now Pat. No. 7,401,537.

(60) Provisional application No. 61/075,897, filed on Jun. 26, 2008, provisional application No. 60/555,849, filed on Mar. 23, 2004.

(51) Int. Cl.

| | |
|---|---|
| ***B21K 5/00*** | (2006.01) |
| ***B23K 9/00*** | (2006.01) |
| ***B23K 9/007*** | (2006.01) |
| *B24D 18/00* | (2006.01) |

(52) U.S. Cl.

USPC ..... 76/115; 219/54

(58) Field of Classification Search

USPC ..... 76/115; 219/54, 125.12, 53; 148/16.5, 148/152, 903, 905

See application file for complete search history.

(56) References Cited

U.S. PATENT DOCUMENTS

| | | | | | |
|---|---|---|---|---|---|
| 4,108,692 | A | * | 8/1978 | Quinlan | 148/534 |
| 4,299,860 | A | * | 11/1981 | Schaefer et al. | 427/556 |
| 4,303,137 | A | * | 12/1981 | Fischer | 175/374 |
| 4,460,053 | A | | 7/1984 | Jurgens et al. | |
| 4,618,269 | A | | 10/1986 | Badrak et al. | |
| 4,679,640 | A | | 7/1987 | Crawford | |
| 4,708,752 | A | * | 11/1987 | Kar | 148/525 |
| 4,755,237 | A | * | 7/1988 | Lemelson | 148/512 |
| 4,781,770 | A | * | 11/1988 | Kar | 148/220 |
| 4,969,378 | A | | 11/1990 | Lu et al. | |
| 5,234,064 | A | | 8/1993 | Lenaburg | |
| 5,291,807 | A | | 3/1994 | Vanderford et al. | |
| 5,580,472 | A | | 12/1996 | Maybon | |
| 5,755,299 | A | | 5/1998 | Langford et al. | |
| 5,785,135 | A | | 7/1998 | Crawley | |

(Continued)

*Primary Examiner* — Alvin Grant

(74) *Attorney, Agent, or Firm* — Dwayne E. Rogge; Schacht Law Office, Inc.

(57) ABSTRACT

Described herein are several methods and apparatuses for treating a cutter tool adapted to be used in tunnel boring operations. In one form, an initial cutter member blank is formed and heat treated prior to a laser cladding process. An alloy is often applied to the surface of the cutter blank adjacent to the cutting elements by the cladding process whereby the cladding process has insufficient heat transfer from the cladding process to reduce hardness properties of the inserts and/or the cutter blank. In one example a fabric-like material defines the region of the exterior hard surface.

20 Claims, 14 Drawing Sheets

(56) References Cited

U.S. PATENT DOCUMENTS

| | | | | |
|---|---|---|---|---|
| 5,836,531 | A | 11/1998 | Maybon | |
| 6,196,338 | B1 | 3/2001 | Slaughter et al. | |
| 6,248,149 | B1 | 6/2001 | Massey et al. | |
| 6,564,884 | B2 | 5/2003 | Bird | |
| 6,601,475 | B2 | 8/2003 | Davies et al. | |
| 6,651,756 | B1 | 11/2003 | Costo et al. | |
| 6,868,572 | B1 * | 3/2005 | Newton | 7/165 |
| 7,360,972 | B2 * | 4/2008 | Sjogren | 407/67 |
| 7,401,536 | B2 * | 7/2008 | Englert et al. | 76/115 |
| 7,673,785 | B2 * | 3/2010 | Weaver | 228/135 |
| 8,161,850 | B2 * | 4/2012 | Sjogren | 82/1.11 |
| 8,347,990 | B2 * | 1/2013 | Lockwood et al. | 175/425 |

* cited by examiner

CUTTER INSERT GUM MODIFICATION METHOD AND APPARATUS

RELATED APPLICATIONS

This application is a continuation of and claims priority benefit to U.S. patent application Ser. No. 12/177,350 incorporated herein by reference. U.S. patent application Ser. No. 12/177,350 claims priority benefit of U.S. Provisional Ser. No. 60/555,849, filed Mar. 23, 2004, U.S. Ser. No. 11/088,397 filed Mar. 23, 2005, and U.S. Provisional Ser. No. 61/075,897 filed Jun. 26, 2008.

BACKGROUND OF THE INVENTION a) Field of the Disclosure

The disclosure is generally related to applying laser cladding to the cutting structure of replaceable rings, "monoblock" assemblies, scraper blades, and other cutter tools.

b) Background Art

Tunnel boring machines often use rolling disc type cutters, scrapers, etc. on the front of their cutter heads to break and remove hard materials such as solid rock and embedded boulders. In certain instances it is advantageous to use cutting structures comprised of a plurality of hard buttons referred to as tungsten carbide Inserts (TCIs) which are cutting elements made usually of tungsten carbide and Cobalt in various relative concentrations embedded into a surrounding softer steel matrix. The TCI cutters stay sharper, longer than conventional cutter discs comprised only of steel. In order to more easily and economically machine a cavity in the steel matrix for the TCI button, the hardness of the steel may be limited to around 43 Rockwell Hardness maximum. Due to its relative softness, the material surrounding the button (the matrix) is worn away much faster than the TCI button. This differential wear causes the buttons to become exposed and the support offered by the matrix erodes and eventually the buttons fall out in the course of operation. This is colloquially referred to as "gingivitis" because the "gums" (matrix) supporting the "teeth" (TCI buttons) wear down and the teeth get knocked out.

Therefore, it is an objective to address this erosion problem by accurately applying an abrasive resistant material around and between the buttons. It is hoped this layer will prevent the deterioration of the "gums" and allow the TCI cutter to survive longer. In one form the layer is applied using a laser cladding process.

In the past manually applied hard facing has been applied to the flanks of TCI button cutting structure with unsatisfactory results. The manual process has lacked sufficient accuracy for localized heat application to apply material close to the button where the protection is most needed. The manual process also applies much more heat to the substrate than laser cladding such that the TCI buttons fell out or cracks ensue because the material became excessively brittle for the operating environment. Therefore, it is proposed that laser cladding allows the life of the TCI button cutter to be greatly extended.

In additional forms of tunneling, scraper-type blades are utilized where in this similar type of scenario a scraper is inserted into a base material. In one form, it is more convenient to apply a surrounding surface having a much higher hardness to protect these blade inserts. In one form, a base matrix material can be applied to a scraper body, and holes can be drilled thereafter or prior to the application. Then the material can be hardened and the bits can be placed fitted therein, or the bits can be fitted thereafter and have the material be hardened by surgical application of heat, such as by laser cladding.

SUMMARY OF THE DISCLOSURE

The disclosure below recites several methods including a method and apparatus for providing a cutter tool having an outer region with a plurality of cavities with cutting elements fixedly positioned therein. The tool has a gum region that engages the cutting elements. The gum region has a surface region with a hardened layer cladded to the surface region where the hardened layer is cladded to the surface region when the cutter tool is preheated above 350° F. Heat is applied to an alloy powder to form the hardened layer whereby there is insufficient heat transfer to the cutting elements to affect the metallurgical hardness properties of the cutting elements. In general, the hardened layer and the cutting elements have a Rockwell hardness at least 20 units greater than the gum region.

The method of treating a cutter ring described above generally first comprises providing a cutter tool that is heat treated with a circumferential region defining a plurality of cavities adapted to receive cutting elements. Then cutting elements are inserted into the cavity regions. The tool may then be heat treated by heating the cutter tool to approximately 350° F.-650° F. Thereafter a laser cladding process is conducted whereby an alloy powder is applied to a cutter tool outer or gum surface adjacent to the cutting elements.

DETAILED DESCRIPTION OF THE PREFERRED EMBODIMENTS

Figure 1:
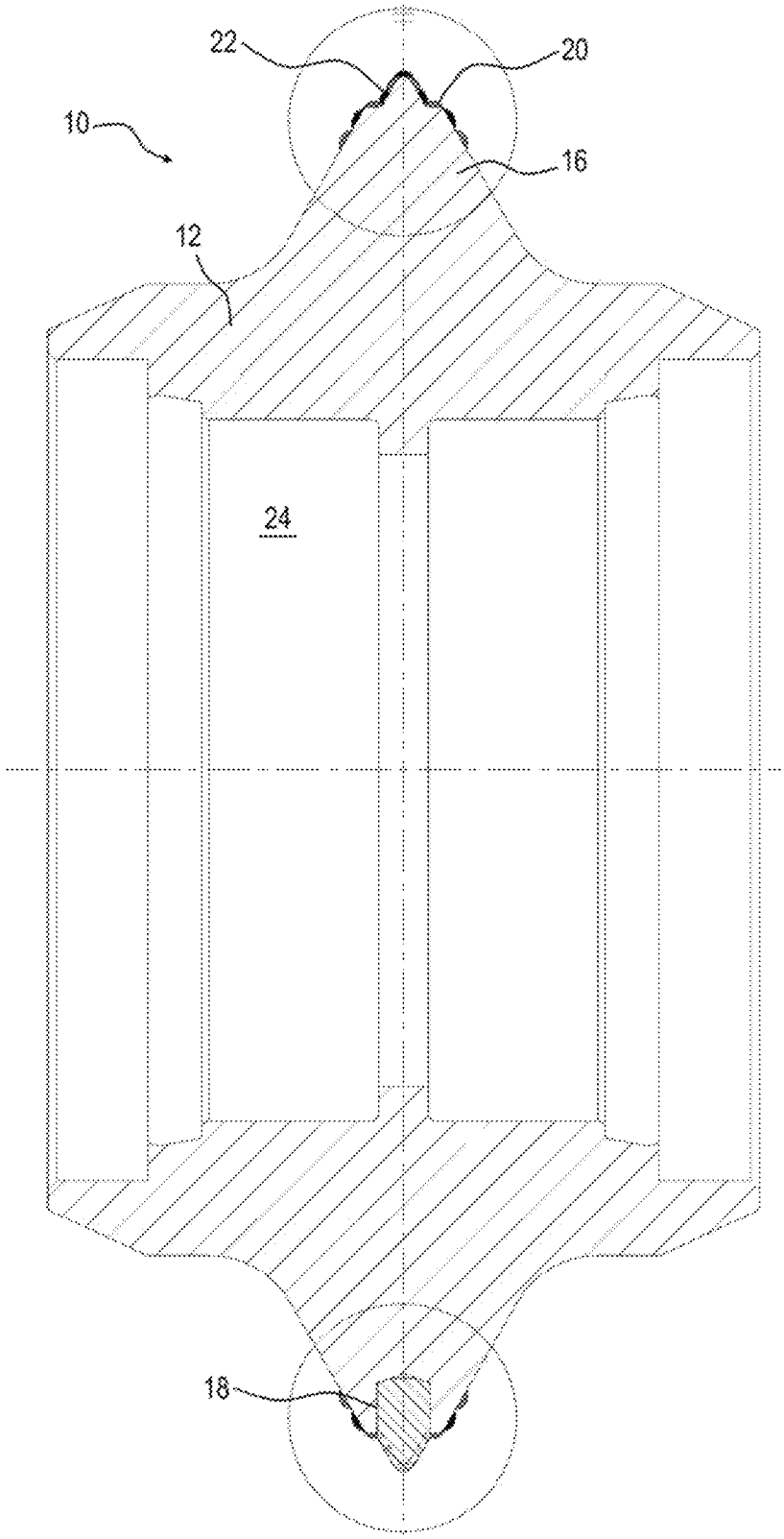
FIG. 1 shows a cross sectional view of a cutter assembly.
Figure 2:
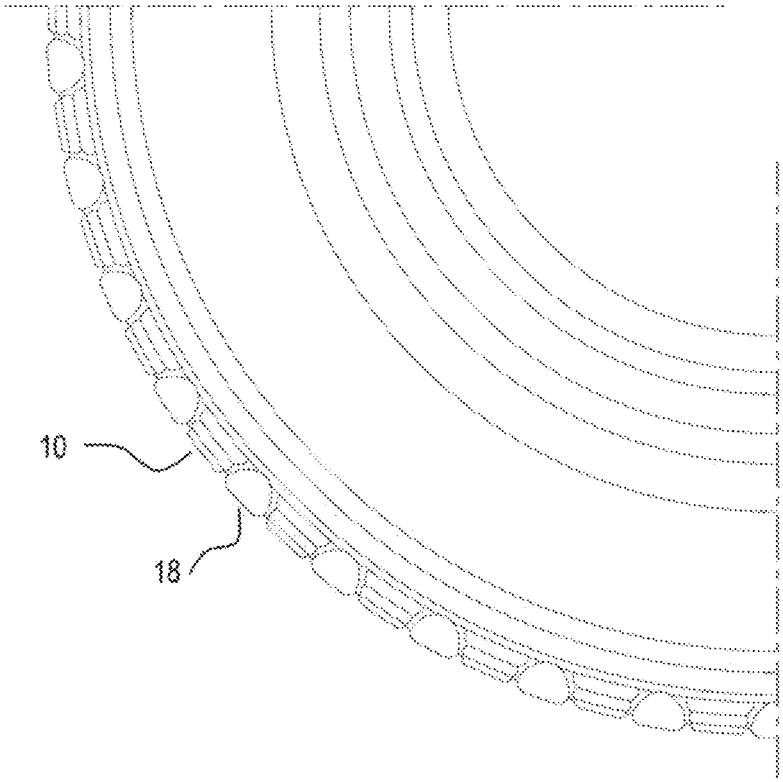
FIG. 2 shows a portion of a cutter ring along the longitudinal axis.

As shown in the embodiment of FIG. 1 there is a portion of the cutter assembly 10 where an integral cutter ring/tool 12 is shown in a cross sectional view. The cutter ring 12 has an interior region 14 and a circumferential region 16. As shown in the lower portion of FIG. 1, cutting elements 18 are inserted at spaced locations around the circumferential region 16. As shown in the upper portion of FIG. 1, the circumferential region 16 further has a gum region 20 which is defined as the material surrounding the cutting elements 18. The gum region 20 as shown in FIG. 2 is defined as the material that is adapted to hold the cutting elements therein and is further described below. In the most common form the cutting elements are pressed fit in to a cavity region of the gum region 20 to form an interference fit. The gum region 20 further comprises a surface region 22. It has been found that providing a surface to the gum area that has a sufficient hardness to reduce the amount of wear is advantageous and prevents gum erosion whereby the surrounding support material is eroded causing the cutter inserts 18 to fall out in application. Therefore, the surface region 22 is hardened in a localized manner by application of a laser-clad material of thickness between 30 thousands to ⅛ of an inch in a broad range and preferably about 1/16 of an inch. Of course the hardened layer could be thicker up to a quarter of an inch and even thicker in some applications as required.

Therefore, in one form of manufacture of the cutter ring 12, raw material is provided and the raw material is rough machined to create the center bore and sides to achieve the basic cross-sectional shape. Thereafter, the raw ring 12 is heat treated and then a plurality of holes are drilled along the circumferential region 16 to provide cavities adapted to receive the cutter inserts 18. Normally, the Rockwell hardness of the cutter ring 12 at this stage in the manufacture process is approximately 32 to 44 (42-43 in the preferred range) Rockwell (Rockwell C scale) in the broader range so the aforementioned holes can be drilled out in an economical manner.

Figure 4:
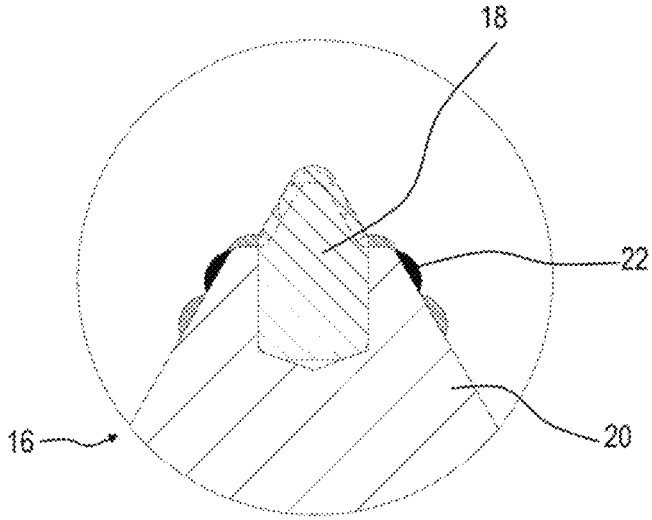
FIG. 4 shows the lower detail region of FIG. 1 including a portion of the gum region along the outer circumferential region of the cutter ring that is interposed between two adjacent cutting element inserts.

The cutting elements 18 are inserted in the cavity regions of the perimeter region 16. In general, the cutting elements 18 are press fitted in the regions to provide an interference fit between the perimeter region 16 and the cutting elements 18. As shown in FIG. 4, the portion of the material in the perimeter region 16 that holds the cutting elements 18 therein is defined as the gum region 20 mentioned above.

The entire assembly may then be preheated to approximately 350° F. to 650° F. and a laser cladding process is then applied to the gum region 20. There will now be a description of a laser cladding process with initial reference to FIG. 5. It has been found that heating the cutter ring 12 to above 650° runs the risk of having the cutting elements 18 fall out due to the thermal expansion of the cutter ring.

Further, it may be advantageous to preheat the cutter tool and derive the metallurgical advantages prior to application of the laser cladding process because the laser cladded hardened layer tends to act as a thermal insulator to some degree, which inhibits subsequent heating of the gum region 20. Therefore, preheating the gum region 20 of the cutter ring 12 (or in fact in general the entire cutter ring 12 and cutting elements 18 are heated as well) has the benefit of the desired metallurgical treating of the gum region properly where it can be slow cooled after the application of hardened cladded layer.

Figure 5:
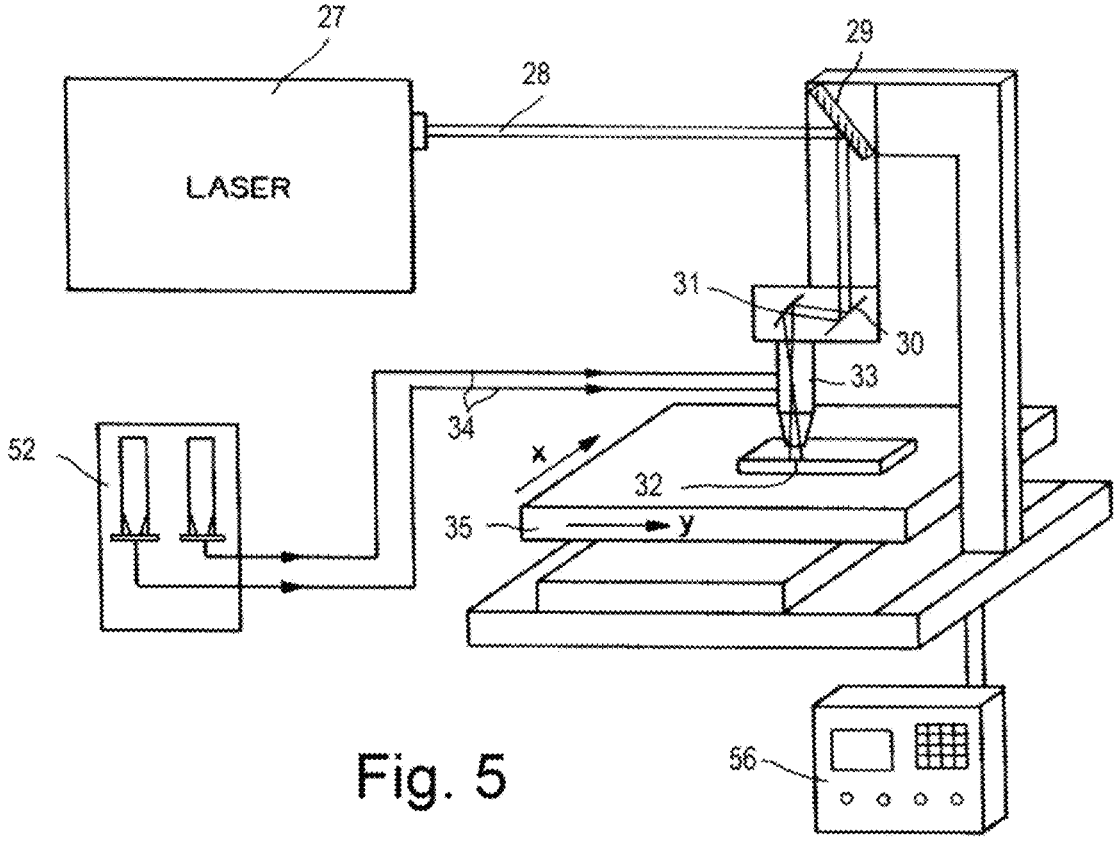
FIG. 5 shows a laser cladding device for implementing a disclosed method.

FIG. 5 is a schematic representation of a laser cladding installation which can be used in implementing the invention. This installation comprises a power laser 27 producing a beam 28 of coherent and monochromatic light(laser). The beam 28 propagates in one direction only, homogeneously, and has substantially only one wavelength. In general there is very little divergence of the beam.

In one form a set of mirrors 29 and 30 are provided to direct the beam onto a focusing head 31. The focusing head 31 directs the laser beam onto the surface to be resurfaced of the cutter ring 12. The focusing head 31 is adapted to focus the laser beam so that the latter impinges on the cutter ring (not shown) in a small impact area 32 where in one form the area is a diameter between about 0.5 and 5 millimeters where the cutter ring is to be positioned. A hemispheric dome shape-cutting element 18 is one form where the hard facing can be applied circumferentially around each button instead of going around the ring cutter 12.

A powder dispenser 52 constitutes a reservoir holding a powdered material for laser cladding the cutter ring 12. This powder contains grains of hard abrasion resistant material which remain solid when exposed to the laser beam and grains of brazing alloy which melt when exposed to the laser beam. In one form powder used is produced by Technogenia S.A.™ of France as disclosed in U.S. Pat. Nos. 6,248,149 and 5,580,472 that are hereby incorporated by reference.

The powder dispenser 52 is adapted to fluidize the powder by means of a neutral gas such as argon or helium and to convey it pneumatically to a spray nozzle 33 via powder feed lines 34. The spray nozzle 33 is adapted to shape the fluidized powder leaving the nozzle into a convergent jet impinging on the same impact area 32 on the cutter ring 12. The fluidized powder jet leaving the nozzle must be as closely as possible coincident with the shape of the laser beam 28 in this area.

The powder dispenser 52 is of a type in which the mass flow rate of powder can be precisely controlled, in order to achieve excellent reproducibility and perfect regularity of the flow rate, which parameters have a direct influence on the regularity and the quality of the resulting resurfacing.

The laser beam impinges on the surface of the gum region 30 to be resurfaced close to the vertical. The outlet orifice of the nozzle 33 is maintained at a constant distance of approximately 10-40 millimeters from the surface to be resurfaced in one form.

In this embodiment, the cutter ring 12 is placed on a table 35 which may be moved horizontally in two directions X and Y by drive means controlled by a numerical controller 56. This causes the area of impact 32 of the laser beam and of the powder leaving the spray nozzle 33 to be scanned over the surface of the gum region 20 to be resurfaced. In one form this is accomplished by rotating the ring 12 about an axis and not necessarily with an x-y table.

Figure 6:
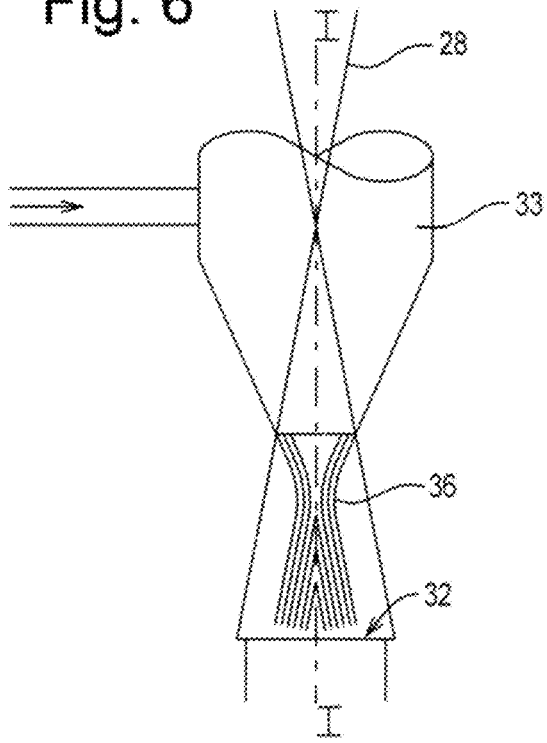
FIG. 6 is a schematic view showing a nozzle for injecting powder coaxial with the laser beam.

In the embodiment shown in FIG. 6 the spray nozzle 33 is of a first type which sprays coaxially with the axis I-I of the laser beam 28. The fluidized powder moves in a helix coaxial with the laser beam 28 and the powder jet 36 is concentrated in order to concentrate the area of impact of the powder onto the area of impact 32 of the laser beam 28 on the surface region 22 to be resurfaced. This impact area 32 is positioned at the surface region 22 as shown in FIG. 4.

Figure 7:
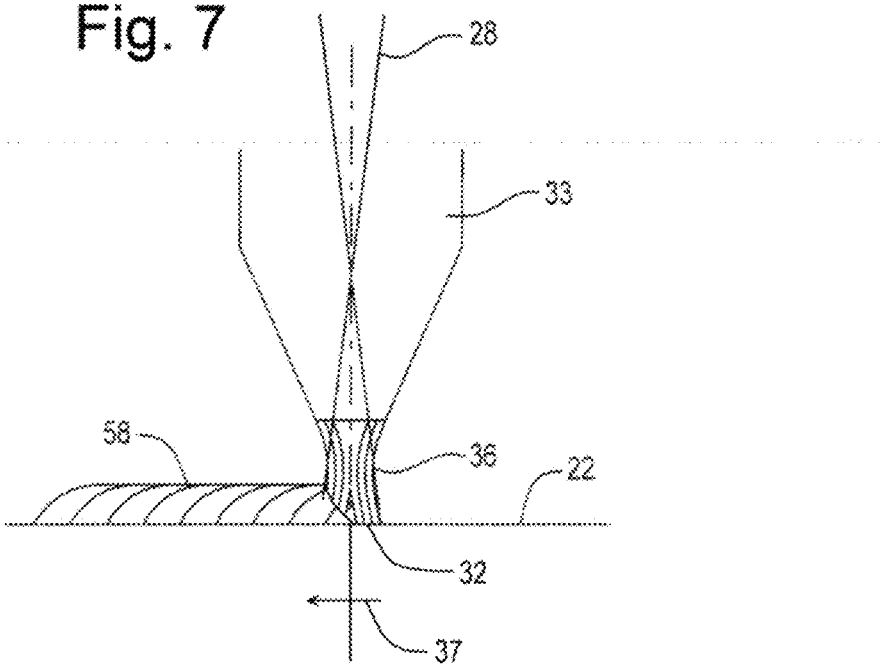
FIG. 7 shows the displacement of the coaxial nozzle and the laser beam for resurfacing a surface region.

FIG. 7 shows progressive laser cladding by displacement of the cutter ring 12 in the direction 37. The area of impact 32 of the laser beam 28 melts the brazing alloy powder, which is brazed to the surface region 22, binding the grains of abrasion resistant material thereupon and, after cooling, progressively forming a deposit 58 on the top of the ridge being resurfaced.

Figure 8:
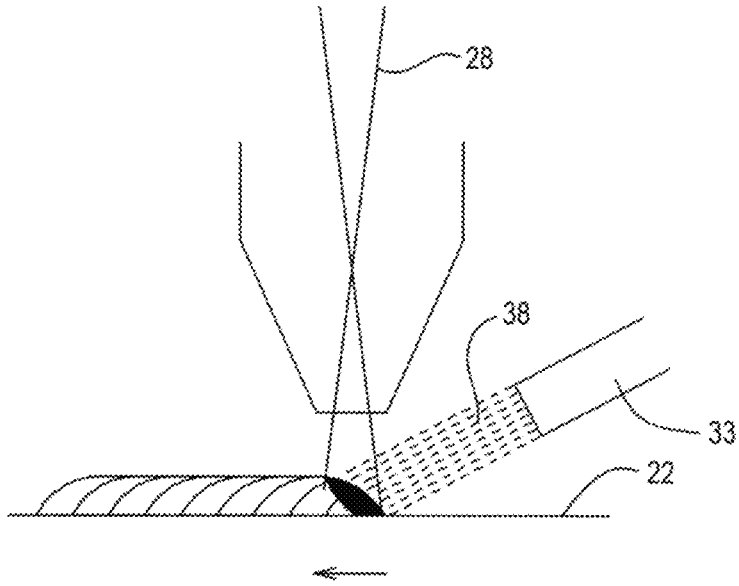
FIG. 8 and FIG. 9 show the displacement of a lateral nozzle and the associated laser beam in a different embodiment.

In the embodiment shown in FIG. 8, the spray nozzle 33 is a lateral spray nozzle which sprays the powder at a given angle to the laser beam 28. The powder jet 38 is preferably in the vertical plane through the surface region 22 to be resurfaced. The cutter ring 10 is scanned longitudinally in alternate directions, as shown in FIG. 8.

Figure 9:
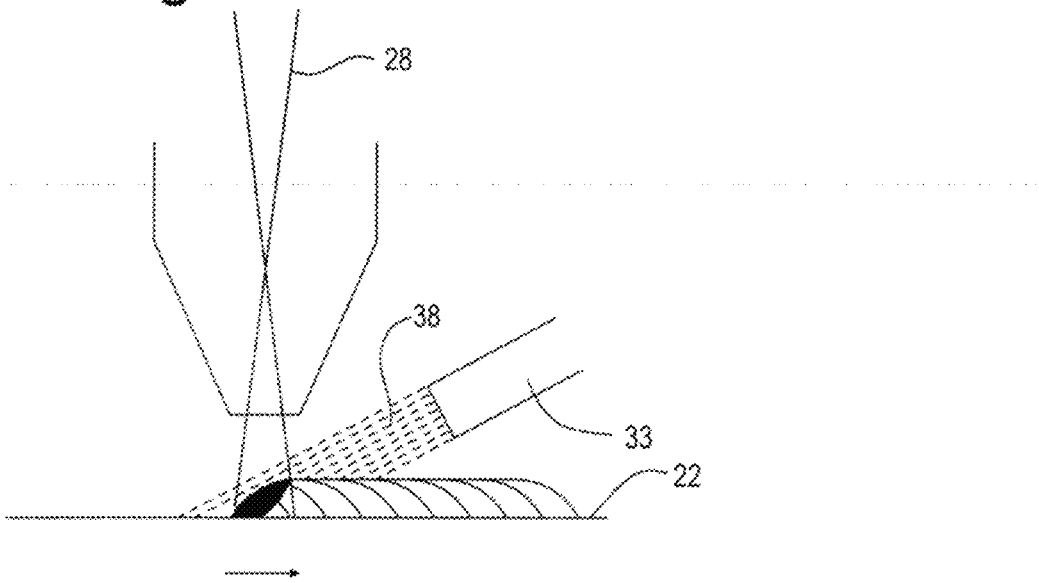

As shown in FIG. 9 the spray nozzle 33 is directing the powder at a given angle to the laser beam 28 on the surface region 22 that is interposed between two adjacent cutting elements 18 along the perimeter outer edge of the cutter ring 12.

The energy of the laser beam 28 melts the surface of the surface region 22 in the area of impact 32 and melts the brazing alloy powder. The powder therefore impinges partly melted on the surface of the surface region 22. The alloy powder is trapped on the surface and melts further during interaction of the laser beam 28 with the surface region 22, so forming a deposit.

Figure 10:
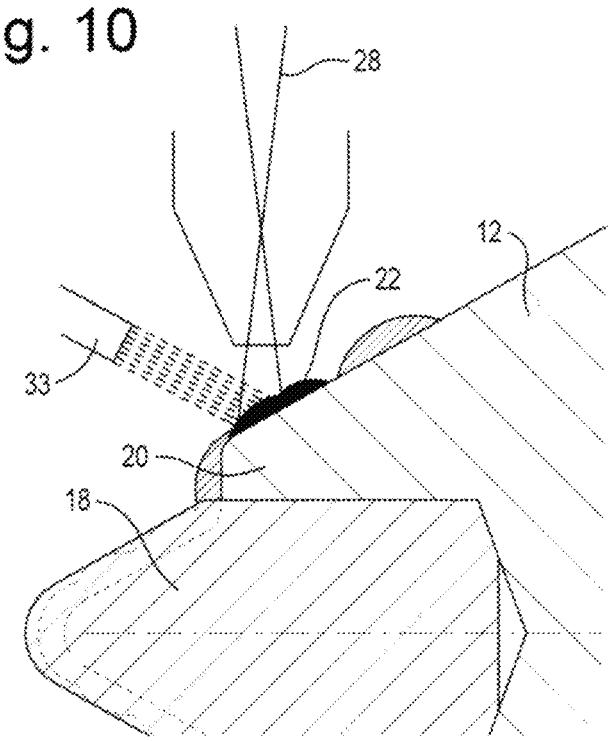
FIG. 10 shows successive stages of cladding a surface region of a cutter ring in cross-section through the insert.

FIG. 10 shows a schematic representation where the laser beam 28 has a focused distribution of light energy and the spray nozzle 33 is ejecting the powder substrate to the surface region 22 which is forming a hardened layer. It should be noted that the laser 28 provides a very localized heat increase whereby the cutting element 18 is not overheated and losing its material properties. It has been found that tungsten carbide degrades when the temperature reaches 900-1100 Fahrenheit. It has been found that the heat transfer to the cutting element 18 is minimal from the laser 28 whereby the cutting element 18 maintains its mechanical properties to function properly in a tunnel boring operation.

Figure 11:
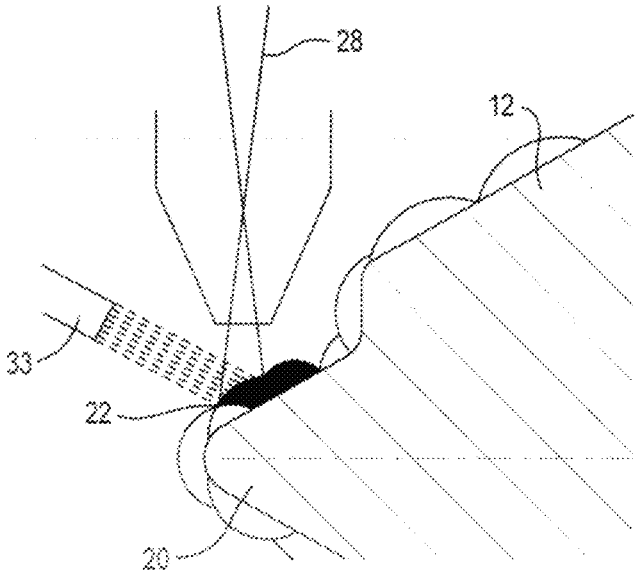
FIG. 11 shows the internal structure of a gum region resurfaced, after machining and in transverse cross-section between the buttons.

FIG. 11 shows the laser cladding process occurring at the gum region 20 at the portion of the surface region 22 interposed between two cutting elements (not shown) on the circumferential ring portion. It is advantageous to harden this area to prevent erosive wear between two adjacent cutting elements.

To match the resurfacing exactly to the upper surface of the ridges, the laser beam has to be controlled so that the area of impact 32 has a diameter substantially equal to the width of the ridge to be resurfaced.

The thickness of the deposit is between 30 thousands to ⅛ of an inch in a single pass. The processing speed can be from a few centimeters per minute to a few meters per minute, depending on the power of the laser 27. A ridge can be resurfaced in a single pass if the thickness of the deposit is a sufficient height.

After the laser cladding is applied no additional machining is needed to be performed. Within the surface region 22 there are no defects in homogeneity caused by formation of the multilayer deposit. The distribution of the hard abrasion resistant material, such as tungsten carbide, grains is uniform within the metal matrix, regardless of the number of layers deposited.

Figure 12:
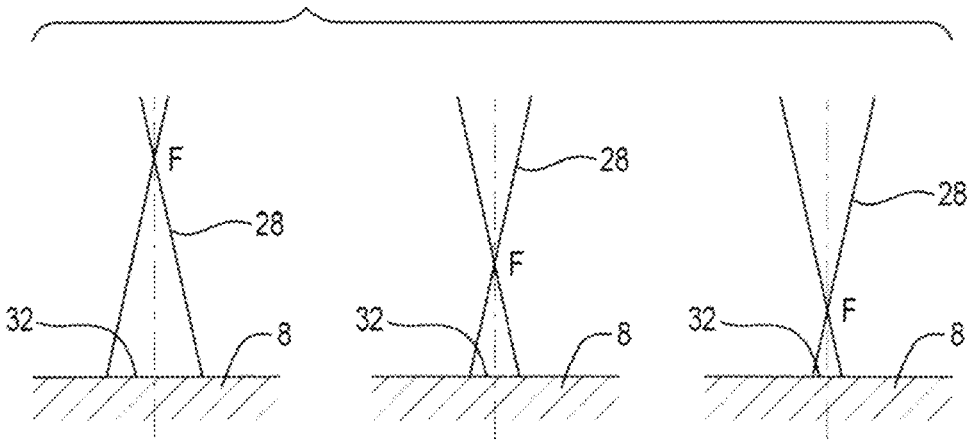
FIG. 12 shows the movement of the focus of the laser beam in a first embodiment.

FIG. 12 shows a first method of adjusting the laser beam 28, with a focus F above the cutter ring 10 to be resurfaced. By varying the distance between the focus F and the surface of the cutter ring 10 to be resurfaced the diameter of the area of impact 32 of the layer beam 28 can be varied, as shown in the figure.

Figure 13:
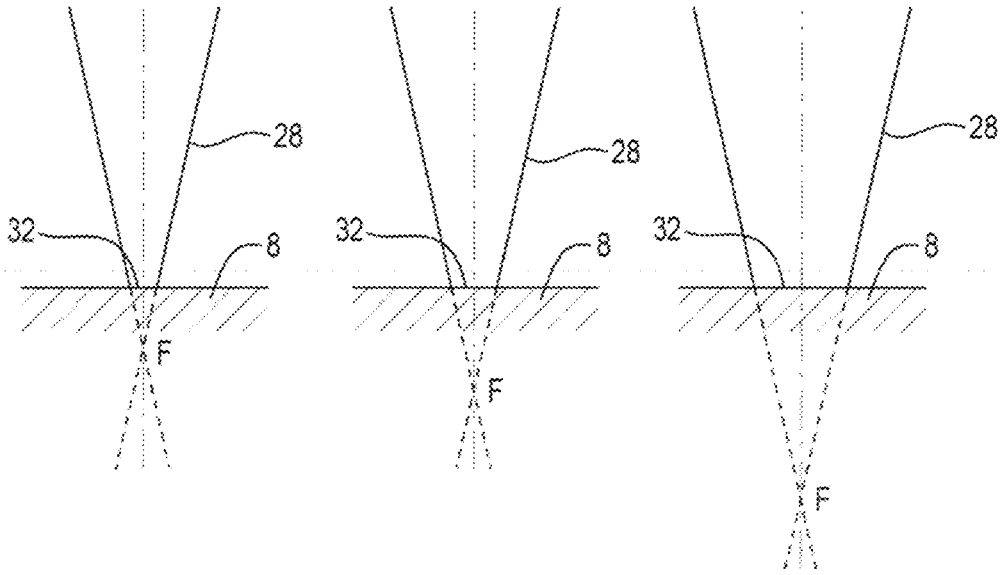
FIG. 13 shows the movement of the focus of the laser beam in a second embodiment.

FIG. 13 shows a second method of adjusting the laser beam 28. In this second method the focus F is below the surface of the cutter ring 10 to be resurfaced and varying the distance of the focus F from the surface of the cutter ring 10 also varies the size of the impact area 32 of the laser beam 28.

At each 180° turn the position of the focus F is modified to compensate for the height of the deposit previously formed, and thus to maintain a constant diameter of the impact area 32.

The method in accordance with the invention has the advantage of accurate reproduction of the geometrical shape of the resurfaced ridges. The surface region 22 is affected minimally by the heating effect of the laser beam during cladding and its distortion due to thermal expansion is thus extremely small or even negligible.

Figure 3:
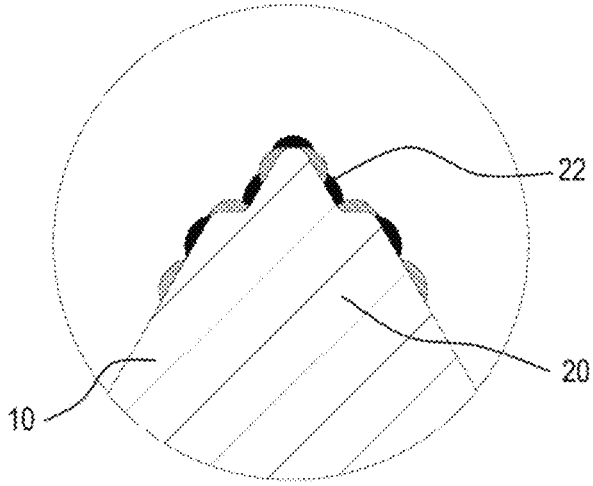
FIG. 3 shows the upper detail region of FIG. 1 including a portion of the gum region on the circumferential portion of a cutter ring with a cutting element insert shown in cross-section.
Figure 14:
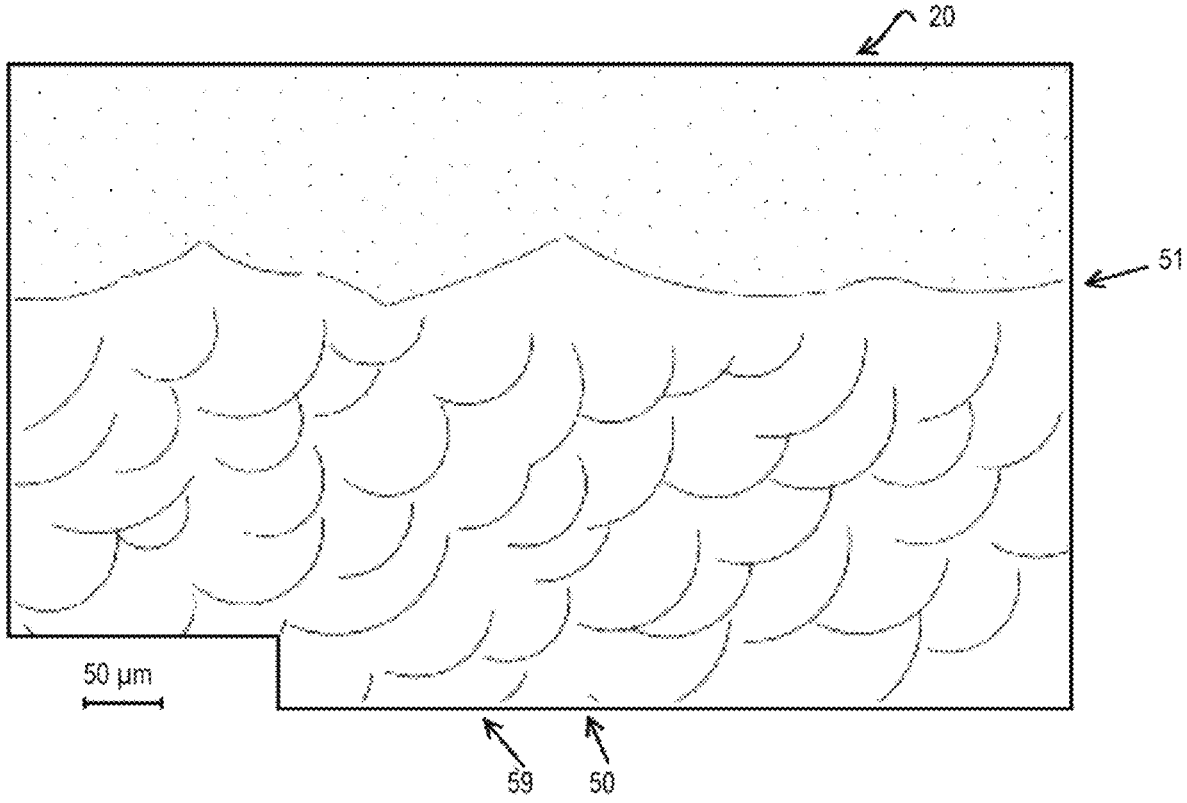
FIG. 14 is a view in transverse section to a smaller scale of the interface area of a laser deposit.

The bond between the cladding and the gum material 20 in FIG. 3 is very strong, as it is achieved by surface melting of the substrate. This is a metallurgical bond which makes the cladding very strongly adherent. The obtained surface is homogeneous, non-porous and produces only a small dilution of the substrate. These features are shown in FIG. 14, which shows a regular distribution of the grains 59 of tungsten carbide in the metal matrix 50 and a thin layer 51 bonding the metal matrix to the gum region 20.

The grains of tungsten carbide 59 are not affected by the laser beam, the present method differing in this respect from plasma sputtering. The grains therefore retain all their mechanical properties, and in particular their hardness is not reduced. This has the advantage that an abrasion resistant material based on generally spherical tungsten carbide grains can be used.

The very high rates of solidification obtained by virtue of the highly localized heat treatment produce a very fine microstructure within the matrix, and consequently excellent mechanical properties. In particular, the metal matrix in one form is based on nickel and chromium has hardness less than the hardened elements contained therein. Several types of material to hold the carbide particles (hardened elements) can be utilized. Nickel is a preferred element because of its tough and ductile and cooperates with the spherical carbide particles without stress risers. In other words the matrix is soft compared to hardened elements such as tungsten carbide spherical particles. By having the cutter ring 10 preheated to 350 to 650° F. the hardness of the heat affected zone (HAZ) directly under the cladding is about 43 to 47 Rockwell hardness. The preheating prior to application of the laser cladding provides more uniform slow cooling. The goal is to reduce rate of cooling to prevent the HAZ brittleness. It is undesirable to form martensite in the HAZ as it is brittle and prone to crack formation. Following the laser cladded process, the cutter ring, inserts, and hardened cladded layer may be cooled by being buried in vermiculite or sand or other slow cooling The preheating to 650° F. may prevent a hardened heat affected zone adjacent to the hardened layer. Because the hardened layer has insulating properties, it may be advantageous to have the ring preheated so the thermal mass of the ring does not absorb the intense heat from the laser whereby causing a temperature gradient and undesirable metallurgical effects of the HAZ. The pre heating could be higher than 650° F. if precautions are taken so the cutting elements do not fall out during cladding. In fact the heating could go up to 900° F. (or the temperature limit of the cutting elements before undesirable metallurgical changes take place) if such provisions are taken.

The coefficient of thermal expansion for the hardened layer is often somewhat less than steel which generally comprises the gum region 20 of the cutter ring 12. The preheating of the cutter ring 12 may have desirable effects of reducing internal stress between the gum region and the hardened layer. With steel as the underlying gum region having a higher thermal expansion coefficient, when the unit cools, the center gum region will contract more than the hardface layer, thereby having slight compressive annular stress in this hardface region and providing a higher circumferential compressive stress. This is indicated by present analysis, and this surface compressive stress is thought to be desirable for reducing possible tension stress which causes the cracks.

When the cladding is conducted on an already heat treated surface at Rockwell 42 (32-52 in the broader range) and then preheated, it generally does not crack after the cladding is applied on a drilling application. The forces in application may be sufficient to start a crack in the heat affective zone and spread throughout the whole ring if the hardness of the gum region is too high. It has been found that if the gum material is too hard the material forms propagating cracks when the cutters are in use in the rigorous cutting/drilling environment. If the gum material 20 is too soft, or unprotected, the abrasive cutting environment erodes the gum material 20 and the cutting elements 18 are forcefully removed or the cladded surface cracks because the underlying substrate of the ring 12 has too much give and does not provide a sufficient hard foundation.

It should be noted that the alloy powder can be directly inserted in the laser beam as the laser passes the cutter ring perimeter surface. Alternatively, the alloy powder can be pre-applied, having the laser pass thereover. The Rockwell hardness of the cutting elements 18 is likely 20 to 30 (or 20 to 40 and above higher in a broader range) more than the surrounding gum substrate area. Rockwell hardness for some cutting tools can be rated in the seventies. Such cutting elements such as nitrided steels are at generally known to have an 80 Rockwell hardness rating so there is a generally broad range of 20 units greater Rockwell hardness from the cutters to the gum region and in some form 30 and above to 40 and above units. It should be noted that there could be multirow cutter inserts adapted to engage the earth in a cutting operation.

It should be noted that the gum region is traditionally a Rockwell hardness of 42 to have maximum abrasive wear resistance; however, given now that the cladding operation provides abrasive resistance, the interior gum region can be of a softer metal such as 32 Rockwell (less than 36 in one form) hardness which is very desirable to machine and work with. Present analysis indicates that the Young's modulus of the steel is approximately the same at a lower hardness whereby the deflection of the gum region is similar given a compressive stress. Therefore, the hardened layer has a sufficient foundation to compress upon so there is a reduced chance of cracking.

Figure 15:
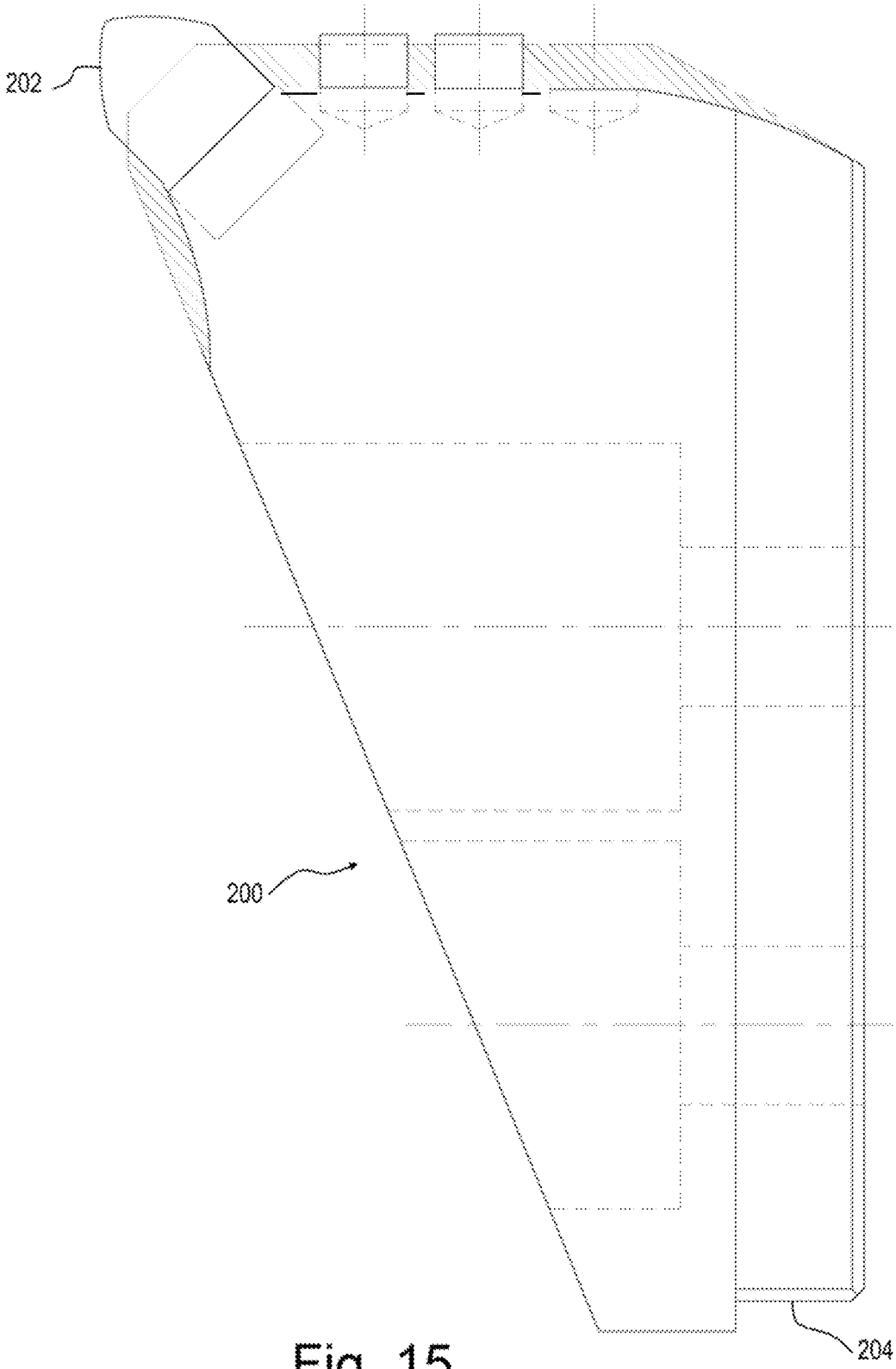
FIG. 15 shows an example of a scraper style insert.
Figure 20:
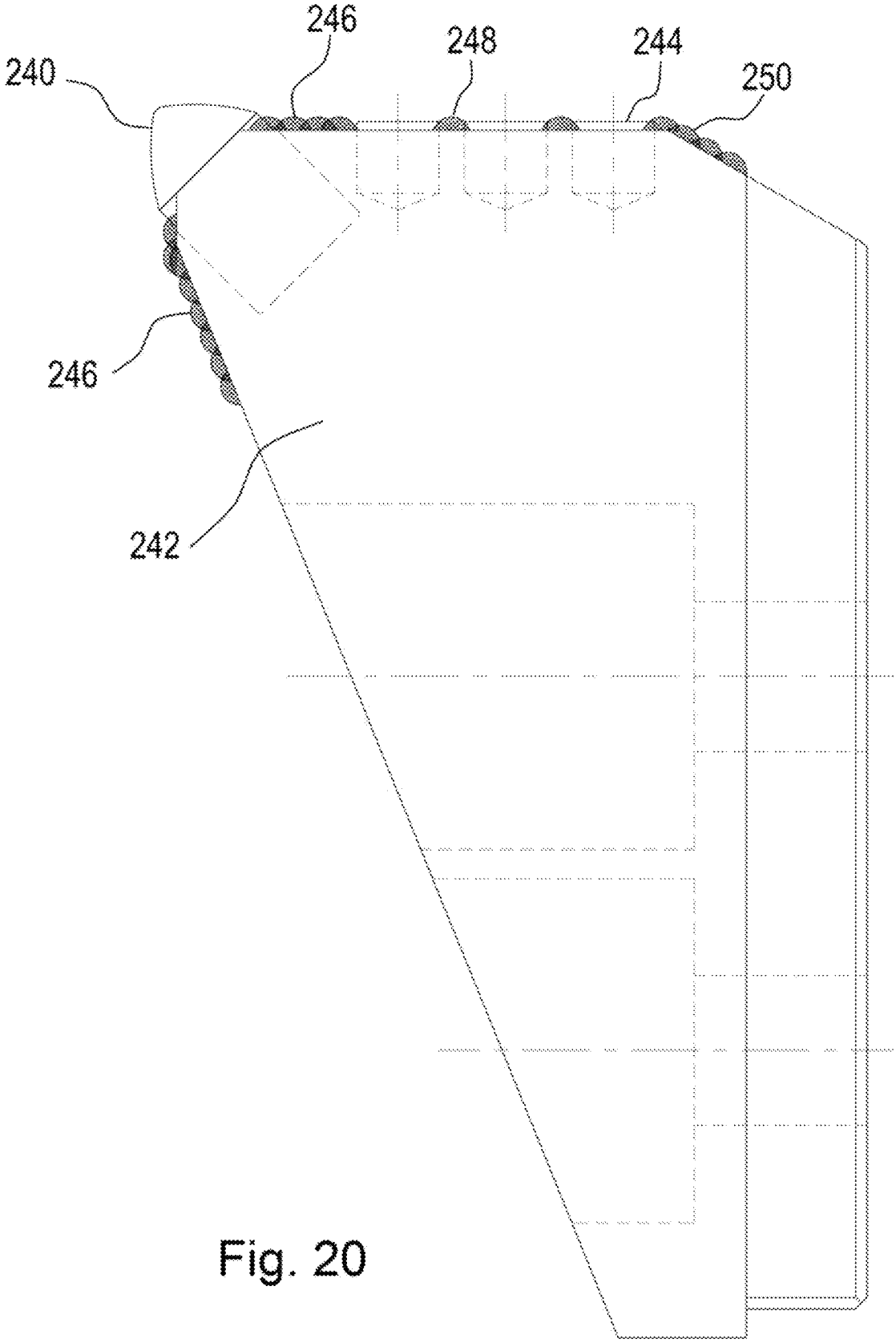
FIG. 20 shows an example of a coated cutting element.
Figure 21:
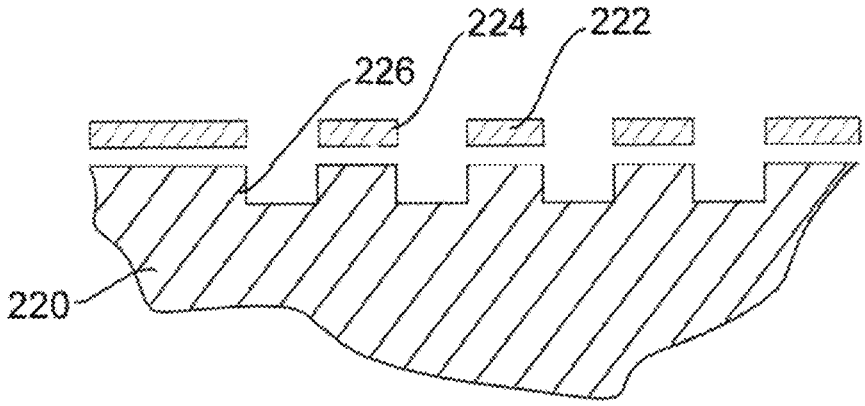
FIG. 21 shows an example of a material prior to being placed upon an underlying substrate, such as a cutter blank.
Figure 22:
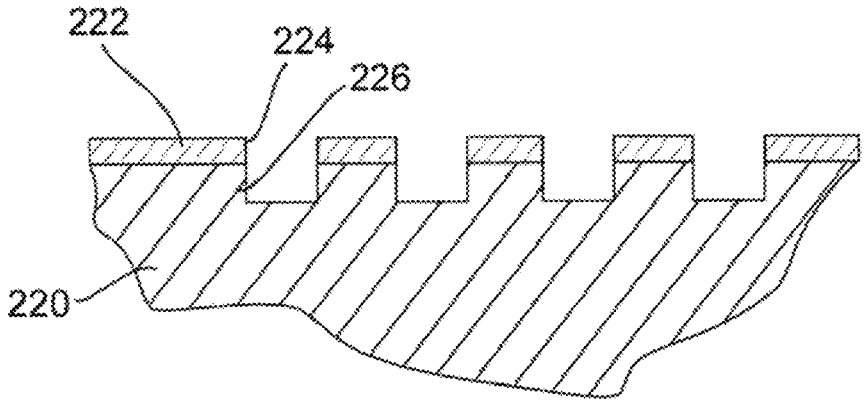
FIG. 22 shows the material blended with the substrate with holes drilled therein to the underlying substrate for placement of bits therein.
Figure 23:
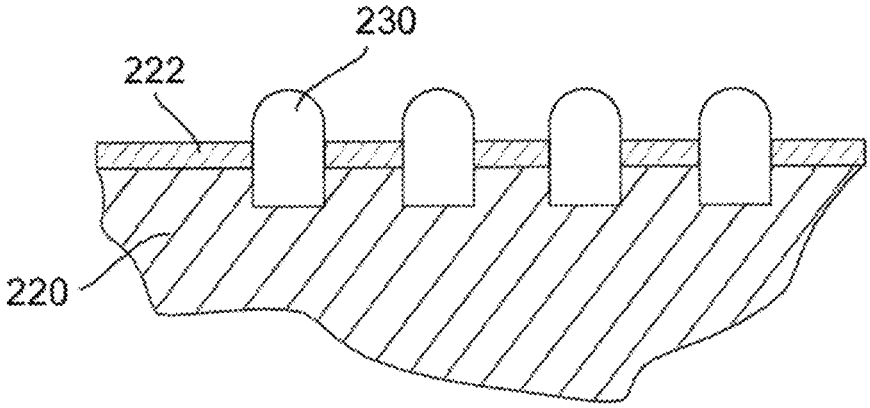
FIG. 23 schematically shows cutter bits placed in a cutting element.

It should be further noted that the cladding process can be used in other types of tools, such as scraper type tools or other tools with tungsten carbide cobalt braze material inserts. In general, scraper type tools can be used on soft ground for cutting therethrough or alternatively be used in conjunction with rolling tools. As shown in FIG. 15, there is an example of a worn scraper blade 200 having a non-cylindrical engagement tip 202 and a base 204. The base can be attached into a machined out slot within a scraper tool housing. In operation of scraper blades in a similar manner to the cutters described above, the surrounding support steel of the main body can wear out, having a "gingivitis" gum-like effect. Therefore, as shown in FIG. 20, supporting the steel with a protective layer of surgically applied hard facing improves the overall life of the scraper. Present analysis indicates that a laser-applied hard facing bead can be applied within, for example 0.5 mm, of the carbide tips, because the heat affected zone (HAZ) is sufficiently small and the braze joint is not affected. In conventional welding, heat goes deep into the part, which affects the braze and can distort the slot or melt the brazing. With a laser, the heat is so directed that the application does not sufficiently affect the metallurgy. In general, the base region 204/scraper body 242 is fit within a softer steel surrounding area and rigidly attached thereto.

In other forms, soft ground tunnel boring machine (TBM) tools can be utilized with the process of a laser-applied bead hard facing. In general, in one form there are two basic types of tools that can have the process applied thereto. A first type of tool is smaller "straight tools" that are generally used on a flat face of a cutter head. Secondly, there are curved tools that can be used around the perimeter region of a cutter head. In general primary wear occurs on the leading edge and secondary wear occurs when the part drags through the earth. These cutter tools are designed to move bi-directionally, and therefore tools generally face one another wherein one is cutting in and an opposing side is being dragged.

Also disclose is the use of a fabric-like material, such as Conforma Clad™, that can be utilized and draped over the part, molded thereto to form a hardened face. In this form, the steel could be coated in carbide, with the exception of the areas which the holes are drilled out to locate the cutter bits.

Figure 16:
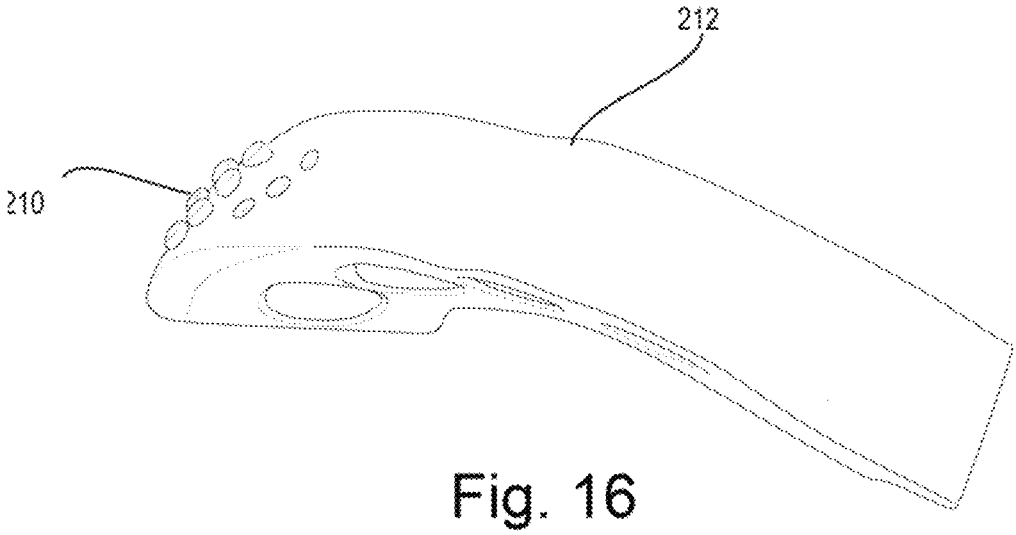
FIG. 16 shows an example of abrasive wear upon a cutting element.
Figure 17:
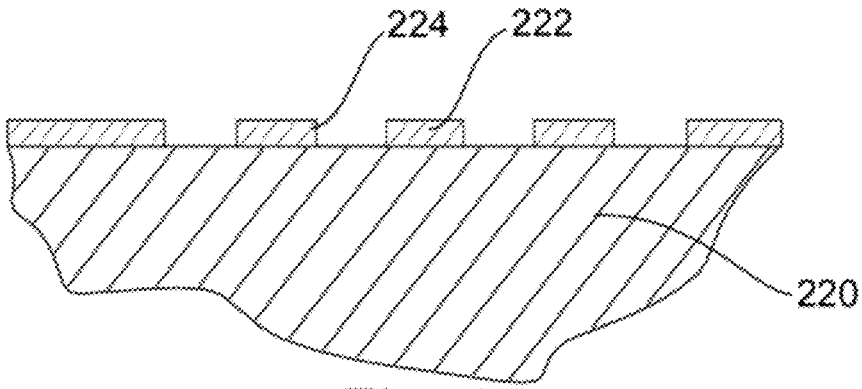
FIG. 17 shows an example of a material placed upon an underlying substrate, such as a cutter blank.
Figure 18:
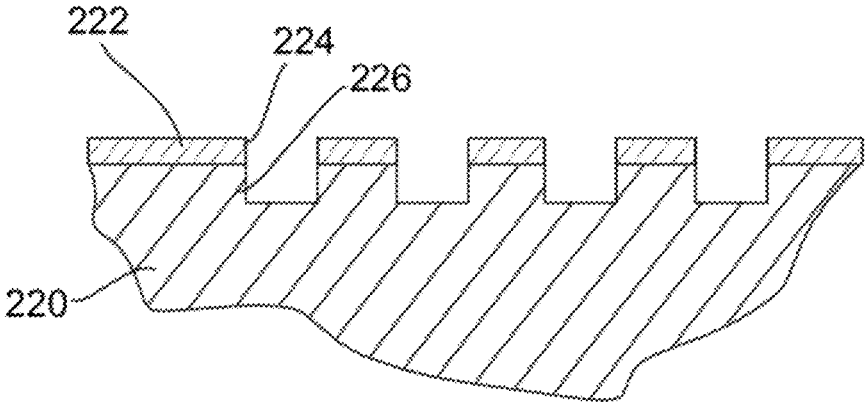
FIG. 18 shows the material blended with the substrate and holes drilled therein to the underlying substrate for placement of bits therein.

As shown in FIG. 16, there is an example of a curved scraping cutter. A plurality of tungsten carbide inserts is indicated a 210. As can be seen in the portion 212, the inserts have worn away by an abrasive type wear referred to as secondary wear. As shown in FIG. 17 there may be a general substrate material 220 such as a cutter blank, such as a soft steel. A braze-on fabric such as Conforma Clad™ 222 may be positioned thereon, having surfaces defining open regions (cavities) 224. As shown in the embodiment of FIG. 18, the openings 224 are provided to allow a drill bit or a similar type of metal excavating device to define the openings 226. In general, the openings can be cylindrical holes or other shaped regions. Inserts 230 such as tungsten carbide cobalt inserts are fitted therein.

Figure 19:
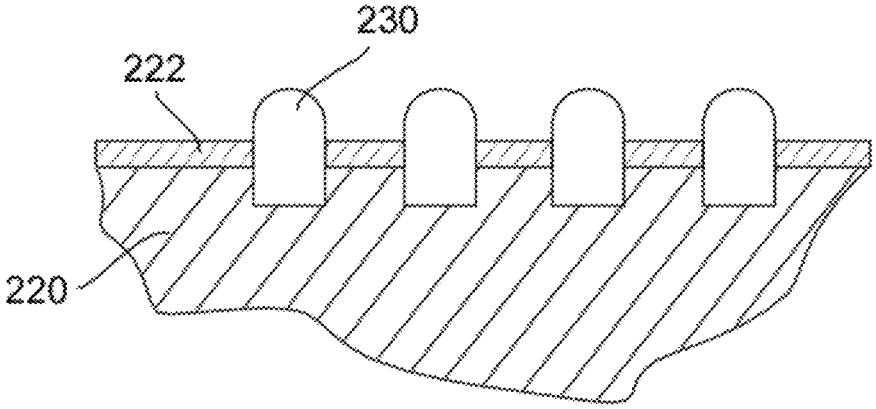
FIG. 19 schematically shows cutter bits placed in a cutting element such as a cutter ring.

Now referring to FIG. 19, it can be appreciated that the cutter bits 230 are fitted in the surfaces defining the openings 226. The fitting could be a press fit, brazing, or other type of fitting where the hardened inserts are fixedly mounted therein.

Therefore, with reference to FIGS. 17-20, can be appreciated that in one form the first step for producing the cutter tool is applying the pliable fabric-like material 222, which in one form can be the Conforma Clad™ braze-on fabric. The pliable fabric-like material can be comprised of a hard facing alloy which is operatively configured to liquefy wherein the molten alloy will wick down into a layer of tungsten carbide particles metallurgically bonding the hard particles to the cutter blank to clad thereto.

Now referring to FIG. 20, a main cutter scraper 240 has been fitted within the scraper body 242. Further, there are secondary protective tungsten carbide-type inserts 244 which are configured to protect against secondary wear during the cutting process. The regions 246, 248 and 250 adjacent the inserts 240/244 have a hard surface applied thereto for protecting the inserts 240/244 as well as the scraper body 242.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A method of treating a cutter tool, the method comprising:

a) preheating the tool to at least 350° F.

b) identifying a gum region positioned in the outer portion of the cutter tool, c) employing laser cladding to the gum region adjacent to cutting elements, d) whereas the cutting elements have a hardness higher than that of the surrounding gum region adjacent thereto and the heat transfer to the cutting elements from the laser cladding process is insufficient to materially alter the hardness of said cutting elements and the gum region is more resistant to erosive wear.

2. The method as recited in claim 1 whereby the cladding process applies a cladding material at a thickness greater than 0.030 of an inch.

3. The method as recited in claim 1 whereby the heat transfer to the cutting elements does not raise the temperature of the cutting elements above 900° F.

4. The method as recited in claim 1 further comprising the step of brazing the cutting elements into cavities within the cutter tool.

5. The method as recited in claim 1 whereby a distance of a laser beam in the laser cladding process to the gum region is adjusted to a consistent width during application on the gum region.

6. A method of treating a cutter tool, the method comprising the steps of:

a) providing a cutter tool that is heat treated with an outer region defining a plurality of cavities adapted to receive cutting elements, b) inserting cutting elements into each of the cavities, c) pre heating the cutter tool to approximately 350° F.-650° F., d) engaging a laser cladding process whereby an alloy powder is applied to the cutter tool outer surface adjacent to the cutting elements.

7. The method as recited in claim 6 where the Rockwell hardness of the cutter tool is between 32 and 44 when forming the plurality of cavities.

8. The method as recited in claim 7 whereby the cutting elements are press fit into the cavity regions.

9. The method as recited in claim 6 whereby the alloy powder is introduced into the laser as it passes along the cutter tool perimeter surface.

10. The method as recited in claim 6 whereby the alloy powder is positioned on the cutter tool outer surface and the laser transfers heat thereto.

11. The method as recited in claim 6 whereby the material immediately surrounding the cutting elements in the cutter tool defines a gum region having a hardness at least 20 Rockwell units lower than the cutting elements.

12. The method as recited in claim 11 whereby the Rockwell hardness of the laser cladded layer on the cutter tool outer surface is at least 20 Rockwell hardness higher than the cutter tool.

13. A cutter tool having a perimeter region with a plurality of cavities with cutting elements fixedly positioned in said cavities, the cutter tool having a gum region with a plurality of cavities therein retaining said cutting elements, the gum region having a surface region, a hardened layer cladded to the surface region where the hardened layer is cladded to the surface region when the cutter tool is preheated above 350° F. and heat is applied to an alloy powder to form the hardened layer whereby the cutting elements are not affected by the heat is applied to an alloy powder and the metallurgical hardness properties of the cutting elements is preserved whereby hardened elements of the hardened layer and the cutting elements have a Rockwell hardness at least 20 units greater than the gum region.

14. The cutter tool as recited in claim 13 where the temperature of the cutting elements during the heat transfer to the alloy powder does not increase above 900° F.

15. The cutter tool as recited in claim 13 where the Rockwell hardness of the cutting elements in the hardened layer is at least 30 units greater than the gum region.

16. The cutter tool as recited in claim 15 where the surface region is comprised of a matrix composition mixed with a tungsten carbide material.

17. The cutter tool as recited in claim 13 where the hardened layer is not more than ⅛ of an inch in thickness.

18. The cutter tool as recited in claim 16 where the Rockwell hardness of the cutter tool is not more than 44 when forming the plurality of cavities in the gum region.

19. The cutter tool as recited in claim 16 where the cutting elements are placed in the cavities after the hardened layer is formed.

20. The cutter tool as recited in claim 16 where the cutting elements are placed in the cavities prior to the application of alloy powder to form the hardened layer.

* * * * *